US008640319B2

(12) United States Patent
McMullen, Jr.

(10) Patent No.: US 8,640,319 B2
(45) Date of Patent: Feb. 4, 2014

(54) NAIL CLIPPING SYSTEM

(76) Inventor: Thomas James McMullen, Jr., Bloomington, MN (US)

( * ) Notice: Subject to any disclaimer, the term of this patent is extended or adjusted under 35 U.S.C. 154(b) by 839 days.

(21) Appl. No.: 12/660,609

(22) Filed: Mar. 1, 2010

(65) Prior Publication Data

US 2011/0209348 A1 Sep. 1, 2011

(51) Int. Cl.
*B23P 11/00* (2006.01)
*A45D 29/00* (2006.01)

(52) U.S. Cl.
USPC ..... 29/428; 30/28; 30/27; 30/29; 132/75.5; 72/379.2

(58) Field of Classification Search
USPC ..... 29/428; 30/27, 28, 29, 131; 132/75.5; 24/698.1, 698.2; 72/379.2
See application file for complete search history.

(56) References Cited

U.S. PATENT DOCUMENTS

| | | | | | |
|---|---|---|---|---|---|
| 2,540,782 | A * | 2/1951 | Hansen | 30/27 |
| 2,999,506 | A * | 9/1961 | Hunt | 132/75.5 |
| 3,042,047 | A | 7/1962 | Plaskon | |
| 3,189,996 | A * | 6/1965 | Casey, Jr. | 30/28 |
| 3,812,868 | A | 5/1974 | Keating | |
| 3,943,948 | A | 3/1976 | Sartore | |
| 4,602,430 | A | 7/1986 | Allen, Jr. | |
| 4,819,673 | A | 4/1989 | McMullen, Jr. | |
| 4,982,747 | A | 1/1991 | Shah | |
| 5,459,926 | A * | 10/1995 | Perea | 30/28 |
| 5,557,849 | A * | 9/1996 | Lee et al. | 30/29 |
| 5,622,191 | A | 4/1997 | McMullen, Jr. | |
| 6,523,545 | B2 | 2/2003 | Rende | |
| 7,194,807 | B2 * | 3/2007 | Weiss | 30/28 |
| 8,082,668 | B2 * | 12/2011 | Samson | 30/28 |
| 2006/0016079 | A1 * | 1/2006 | Weiss | 30/28 |

FOREIGN PATENT DOCUMENTS

KR 2011065027 A * 6/2011

OTHER PUBLICATIONS

PCT Notification of Transmittal of the International Search Report and the Written Opinion of the International Searching Authority, or the Declaration for related International Application PCT/US2011/026072, No Date.

* cited by examiner

*Primary Examiner* — Essama Omgba
(74) *Attorney, Agent, or Firm* — Mark A. Litman & Associates, P.A.

(57) ABSTRACT

A nail clipping system comprises two opposed surfaces (relatively flat, curved or ergonomically or functionally non-planar) hinged at one end. The hinge may be a living hinge made from the same or similar structural material as the opposed surfaces, or may be a spring-loaded hinge connecting the two opposed surfaces. Associated with an upper one of the opposed surfaces is at least one (relatively) downward exterior plate, and associated with a lower one of the opposed surfaces is at least one (relatively) upward interior plate directly opposed to a downward exterior plate. The at least one downward exterior plate has a slot therein accessible to finger nails. The slot may be linear or curved (to accommodate the curve of nails). The at least one upward interior plate has a blade element that slides along an interior surface of the downward exterior plate and across the slot therein.

9 Claims, 5 Drawing Sheets

NAIL CLIPPING SYSTEM

BACKGROUND OF THE INVENTION

1. Field of the Invention

The present invention relates to the field of nail clipping or nail trimming systems, particularly human nail clipping or human nail trimming systems, and particularly for infant nail trimming or infant nail clipping systems.

2. Background of the Art

Human nails on the hands and feet, and especially human fingernails, are in need of regular reduction in length and shaping or they become unsightly and even make the person subject to injury when nails inadvertently catch or snag on materials. Prior to technology, these nails would wear down by abrasion during work and movement.

There are numerous types of human nail shaping, cutting, clipping and trimming systems available in the marketplace. The various types of nail reduction systems includes filing systems (nail files, emory boards, and the like), scissors and scissor-type systems, and the traditional leveraged nail clipper. Examples of the leveraged nail clipper may be seen in U.S. Pat. Nos. 3,812,868 (Keating); 4,602,430 (Allen); 4,982,747 (Shah); 3,943,948 (Sartore); and 6,523,545 (Rende). These leveraged nail clippers have one common aspect to them, two opposed, forward-facing blades are attached to hinged surfaces, and the hinged surfaces are pressed together to snip nails inserted between the forward-facing blades.

A complex plastic format having side nail cutting access is shown in U.S. Pat. Nos. 4,819,673 and 5,622,191.

All of these systems work well for mature nails and mature operators, but there is always room for improvement, especially when using clippers with small children and infants, where unexpected movement can cause injury to the child or infant.

SUMMARY OF THE INVENTION

A nail clipping system comprises two opposed surfaces hinged at one end. Associated with an upper one of the opposed surfaces is a downward exterior plate, and associated with a lower one of the opposed surfaces is an upward interior plate. The downward exterior plate has a slot therein accessible to finger nails. The upward interior plate has a blade element that slides along an interior surface of the downward exterior plate and across the slot therein. Upon insertion of a nail through the slot, the two opposed surfaces are pressed together, flexing at a hinge, and the blade slides across the interior face of the slot and slices the nail extending through the slot. With respect to the infant-sized and designed structure, it is essentially impossible for the blade to contact the flesh of any person whose nail is being cut because the spacing in the slot will not allow both nail and flesh to extend therethrough. Although the terms "upward" and "downward" are used, these are relative terms and reversing or rotating the system so that upward and downward are reversed with the opposed plates does not alter the function or definition of the system. By appropriate selection of an appropriate size clipping system, any user would be safe.

DETAILED DESCRIPTION OF THE INVENTION

Figure 1:
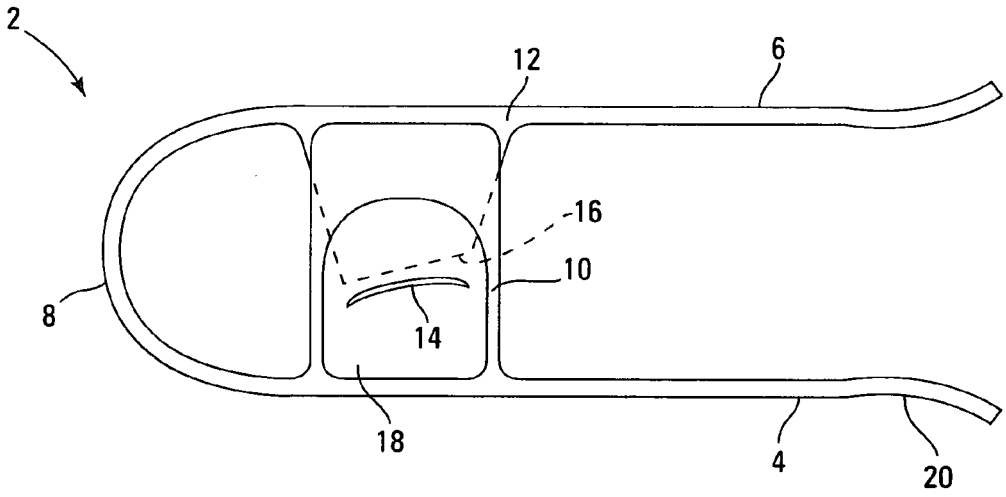
FIG. 1 shows a side view of a nail clipping system according to the present technology.

A general description of the system of the present technology can be considered as a nail clipping system comprising:

a) two opposed surfaces hinged at one end, b) associated with an upper one of the two opposed surfaces is at least one exterior plate, c) associated with a lower one of the opposed surfaces is at least one interior plate directly opposed to the exterior plate;

d) the at least one exterior plate has a slot therein accessible to finger nails; and e) the at least one upward interior plate has rigidly attached thereto a blade element that slides along an interior surface of the downward exterior plate and across the slot therein.

The rigid attachment of the blade element is a meaningful limitation. This means that the relative angle of the upper edge of the interior plate remains constant as the system is used and the relative position of the blade changes with respect to the slot. This is simpler, different and much more efficient then the complex interior sliding arrangement of the plastic bodied nail clipper of U.S. Pat. Nos. 4,819,673 and 5,622,191.

A nail clipping system comprises two opposed surfaces (relatively flat, curved or ergonomically or functionally non-planar) hinged at one end. The hinge may be a living hinge made from the same or similar structural material as the opposed surfaces, or may be a spring-loaded hinge connecting the two opposed surfaces. Associated with an upper one of the opposed surfaces is at least one (relatively) downward exterior plate, and associated with a lower one of the opposed surfaces is at least one (relatively) upward interior plate directly opposed to a downward exterior plate. The at least one downward exterior plate has a slot therein accessible to finger nails. The slot may be linear or curved (to accommodate the curve of nails). The at least one upward interior plate has a blade element that slides along an interior surface of the downward exterior plate and across the slot therein. The blade and/or the exterior plate are preferably angled such that the interior angle formed by the exterior plate and the blade is less than 180, so as to slide the blade along the exterior plate presses outwardly against the exterior plate. The exterior plate may also be slightly bowed, with a slightly concave face outward of the exterior plate to facilitate the tension of the blade against the inner surface of the exterior, downward facing plate. Upon insertion of a nail through the slot, the two opposed surfaces are pressed together, flexing at the hinge, and the blade slides across the interior face of the slot and slices the nail extending through the slot. It is impossible for the blade to contact the flesh of the person whose nail is being cut because the spacing in the slot will not allow both nail and flesh to extend therethrough. Although the terms "upward" and "downward" are used, these are relative terms and reversing or rotating the system so that upward and downward are reversed with the opposed plates does not alter the function or definition of the system.

The structural materials used in the system of the present technology would require any material that can hold an edge when used against nails. These materials are preferably metals for the blade and at least the interior surface of the downward facing plate (with the slot therein), although rigid polymers, ceramics, composites and other materials can be used. Other sections of the system may be polymeric, composite, metal and combinations thereof. In a preferred construction, most or all elements of the system are metal, and essentially may be a single piece of metal bent, stamped, coined, burnished and abraded in the desired shape and thickness.

Reference to the Figures will assist in an appreciation of the present technology.

FIG. 1 shows a side view of a nail clipping system 2 according to the present technology. An upward extending exterior plate 10 is shown attached to a lower opposed plate 4. Pressure against finger recession 20 on the lower opposed plate 4 will cause the lower opposed plate 4 and the attached slot 14 to move by flexing of the hinge 8. At the same time the recession 20 on the lower plate 4 is pressed, the opposed depression on the upper opposed plate 6 is pressed, forcing the downward extending interior plate 12 and the blade 16 attached thereto to move downward, sliding the blade 16 across the slot 14, providing a cutting or slicing action on any nail inserted through the slot 14. Of particular note in FIG. 1 is ground or recessed (e.g., by molding or any other physical or chemical process, such as etching) area 18. This recessed area is shown on the exterior of the exterior plate 10 so that the recess does not affect the direct contact of the blade 16 with an interior surface of the upward plate 10 at the region of the slot 14. The recess 18 is used to control the thickness of the plate 10 around the area of the slot 14. The ground area 18 may make the thickness of the exterior plate 10 around the slot 14 have dimensions of between 0.0075 to 0015 inches. This will allow a length or section of the nail of like dimension to be cut. The widest width dimension (usually in the center of the length of the slot 14) on the slot 14 should be between 0.015 to 0.030 inches, preferably between 0.015 and 0.025 inches, and more preferably between 0.018 abs 0.022±0.001 inches, and most preferably between 0.019 and 0.021.+–.0.001 inches. The system of the present invention may provide a single cutting surface (a blade on only one side of the device) or a dual cutting system with blades and slots on both left and right hand sides of the system. The slots on opposed sides in a two slot system may be the same dimensions or different dimensions to accommodate nails of different dimensions. Similarly, the shape of the slots on opposed sides may be different to assist in accommodate nails of different curvatures. It is possible to have the device produced in multiple parts and assembled if desired. One element that is most conveniently manufactured as a separate element and combined with the device is an abrasive element (not shown). This element forms a cage or nail clipping capture component inside of the device and an abrasive surface similar to an emery board or nail file on the outside of the device.

It is of note that the blade 16 and the slot 14 may be aligned such that the blade will initially contact any nail inserted through the slot 14 at an angle (as opposed to a blade contacting a nail in a parallel position against a flat aspect of the nail), and that this angle will change as the blade slice through the nail. This design feature may cause the blade to have an angle with respect to the initial contact with the face of the slot at between 5-30 degrees, preferably between 10 and 25 degrees.

Interior surfaces (32*a* 32*b* of FIG. 3) of the upper plate 6 and lower plate 4 may be stamped, bent, or otherwise structured to provide a nail retaining area, such as an indentation or even box (not shown).

Figure 2:
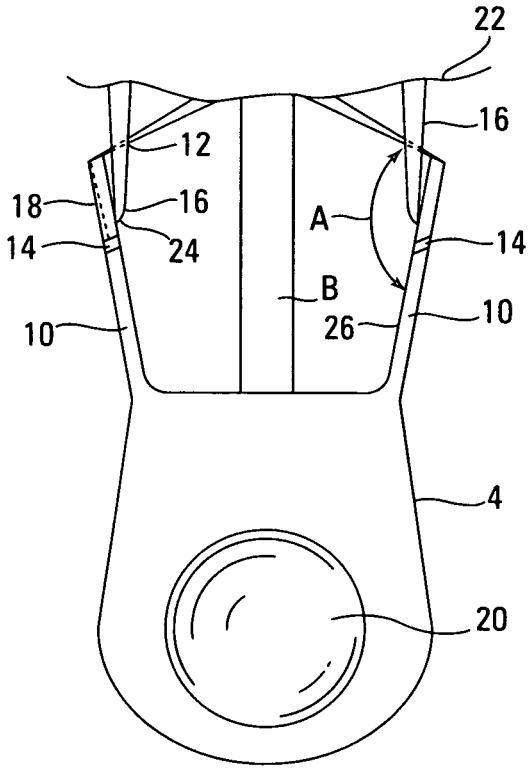
FIG. 2 shows a perspective forward-looking partial cutaway view of a nail clipping system according to the present technology.

FIG. 2 shows a perspective forward-looking partial cutaway view of a nail clipping system according to the present technology. Numbers in FIG. 2 that are the same as numbers in FIG. 1 are like elements. The system 2 has been cutaway along line 22 so that the upper downward plate 6 is not shown. The most important additional feature shown in FIG. 2 is the angle A formed by the blade 16 and the interior face 26 of the upward facing exterior plate 10. Also shown is the beveling 24 that places a blade 16 so that a sharp edge of the blade slides along the interior surface 26 of the plate 10. Also shown in FIG. 2 is the angling of the exterior plate 10 to assist in the cutting action of the blade 14 against the interior surface 26 of the plate 10.

Figure 3:
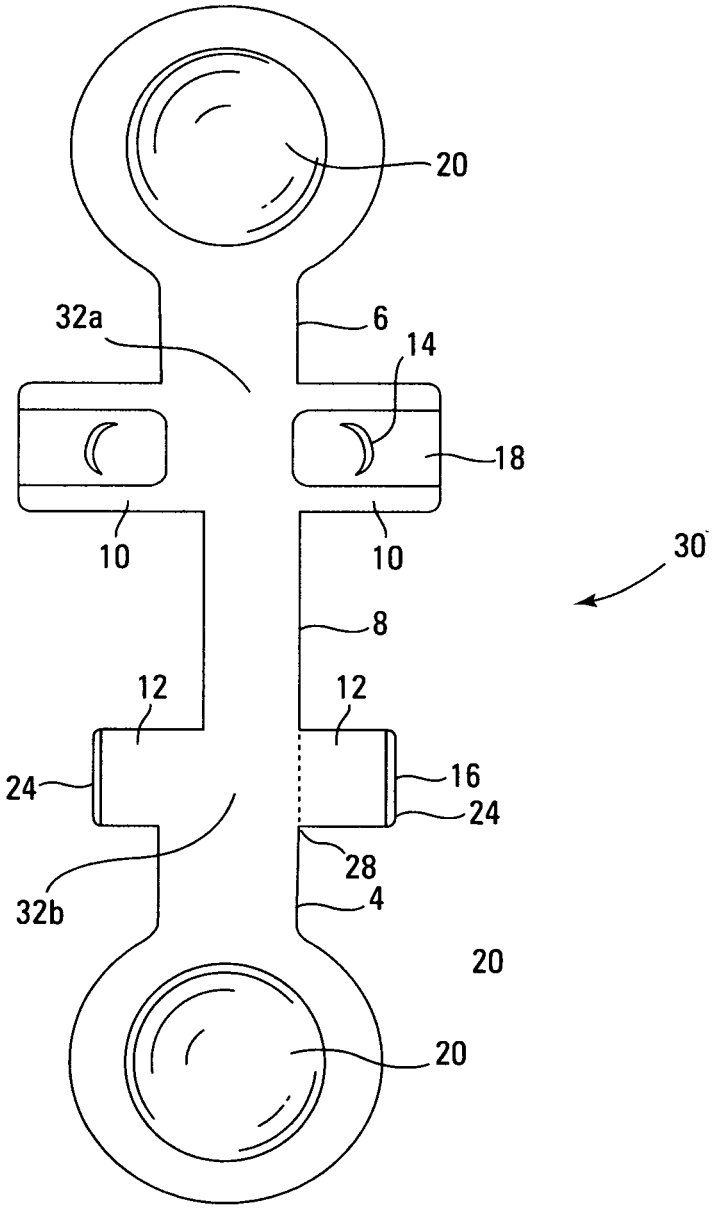
FIG. 3 shows a shaped and refined single metal element that can be bent into a clipping system of the present technology.

FIG. 3 shows top view of a shaped and refined single metal element that can be bent into a clipping system of the present technology. Numbers in FIG. 3 that are the same as numbers in FIGS. 1 and 2 are like elements. The device 2 of FIG. 1 would be formed from this preformed element 30 by bending the hinge 8, bending the plates 12 and bending the plates 10 in a same downward direction, away from the top of this top view. The plates 12 would be positioned within the bent plates 10 so that the plates 10 would be exterior to the device 2 of FIG. 1.

Figure 4:
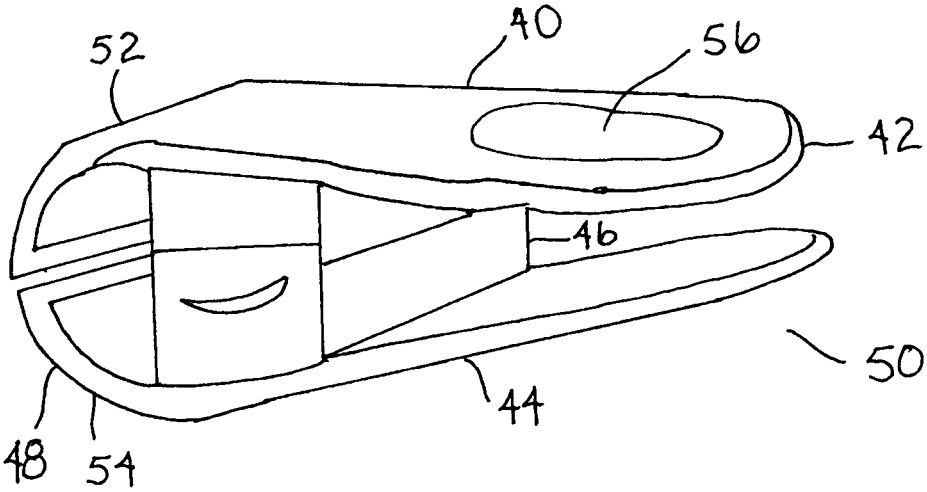
FIG. 4 shows a multiple piece element comprising a central insert and an active housing that forms an alternative embodiment of the present invention.

FIG. 4 shows a multi-piece nail cutting system 40 according to technology described herein. This alternative nail cutting system 40 comprises a top portion 42 and a bottom portion 44 which are in a flexing relationship with each other about plane 50. The flexing relationship may be based on a living hinge 48 at the rear 52 of the top portion 42 and the rear 54 of the bottom portion 44. Between the top portion 42 and the bottom portion 44 is a cutting component 46, which may be a single element or at least two elements engaging each other. This cutting element 46 will be further described in FIG. 5. The top portion 42 and bottom portion 44 are pressed simultaneously and the cutting element 46 is engaged. In a preferred embodiment, the cutting element 46 (whether a single piece or multiple pieces in engagement) are fitted, snapped, fused, adhered, screwed, slid or otherwise fixed in position between the top portion 42 and bottom portion 44 and the device 40 is ready for use. The device 40 may be provided with a single-side cutting function or a two-sided (left and right) cutting function as described herein.

Optionally, a hole or opening or slot 56 may be on the top portion 42 and bottom portion 44 to provide access to a blade cleaning step or to provide an additional functional element to the system 40. For example, a pad or small opening-shaped emery board (not shown) may be inserted into the opening 56. The cut finger nail may be inserted into the opening 56 and rubbed against the pad or board and the sharp edges of the cut nail may be buffed.

Figure 5:
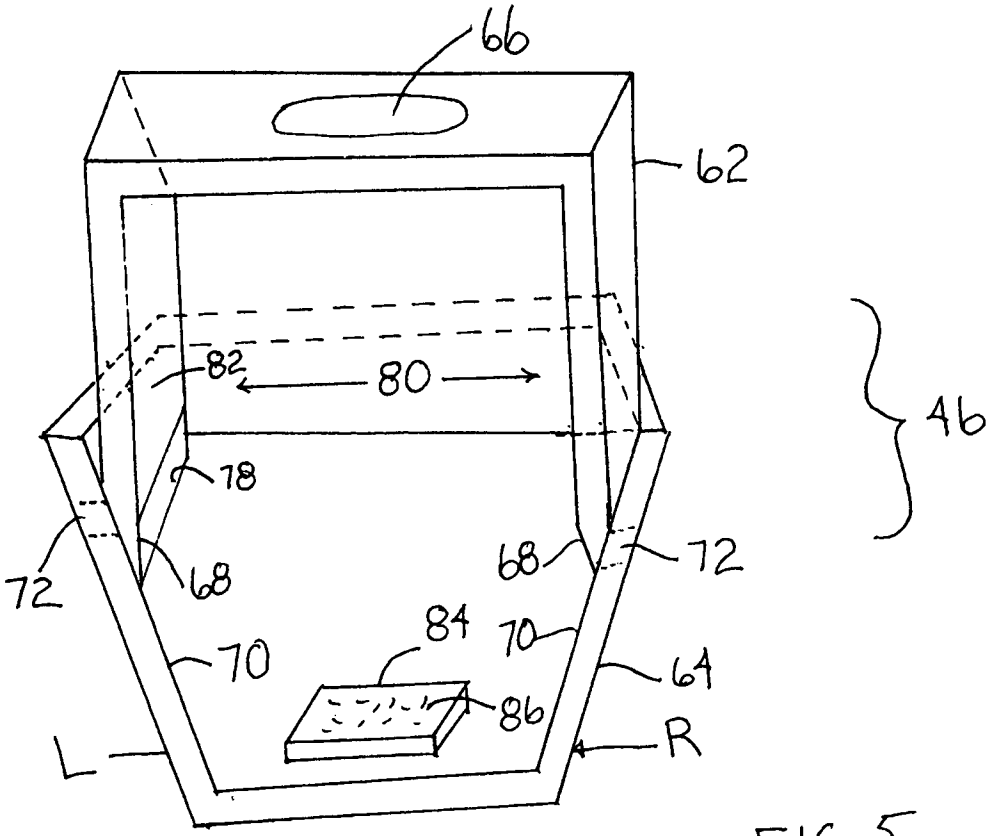
FIG. 5 shows a perspective front end view of a cutting element according to disclosed technology.

FIG. 5 shows a perspective front end view of the cutting element 46. The cutting element 46 is shown with two components, a top bladed element 62 and a lower guiding element 64. The elements 64 and 62 devices may be reversed with respect to "top and bottom" and are shown in this manner for convenience. The top bladed element 62 is shown with two interior blades 68 that abut the interior faces of the walls 70 of the lower guiding elements 64. The blades 68 slide along the interior faces of the walls 70 and cut any material (e.g., a nail) that protrudes through the slot openings 72 that extend through the walls 70. The relative angles between the bladed element 62 and the guiding elements 64 cause tension and maintained cutting contact between the blades 68 and the interior walls 70 of the guiding element. The longitudinal (lengthwise) length of the blades 64 should be longer than the length of the slots 72 to reduce any tendency of the blades 64 to catch in the slots 72. A back area 80 is shown overlapping the top bladed element 62 and the lower guiding element 64. That overlapping area 80 may actually be a sliding or flexing engagement between the top bladed element 62 and the lower guiding element 64. Therefore the cutting element 46 may be a single piece or two pieces engaged with each other detachably of permanently. The overlapping area 80 must allow relative movement between the top bladed element 62 and the lower guiding element 64. To that end, it may form a living hinge, may be a separate hinge element (e.g., a rubber tube connection, spring, hinge, etc.) or may be a slide function allowing relative movement between the top bladed element 62 and the lower guiding element 64 when the top portion 42 and bottom portion 44 are compressed.

With adult users or larger size nail clipping systems, the blade may be constructed to as to slide against the outside of the walls of the lower element, thereby requiring that the edge of the blade slide against the exterior wall of the guiding element. In that alternative construction, the force of the blades would tend to make the lower guide element compress inwardly rather than expand outwardly (as shown in FIG. 5) to assure contact between the blade and the guide surface.

One the design of the cutting element 46 has been determined (e.g., one piece, two pieces, flexing, sliding, internal blades, external blades) it may be associated with the top portion 42 and bottom portion 44 to form the cutting system. The size of slots 72 and 14 may be varied according to intended use, such as cutting devices specifically for infants and cutting devices for larger persons and even claws for animals. For example, the slots may be design to accept cat claws and/or dog claws, and the blades would be made of strengths adjusted for the needs of the ultimate use. The blade edges 78 on the blades 68 may be replaceable or interchangeable, or entire sections 82 of the blade element 62 may be replaceable or the entire blade element 62 may be replaceable, or the entire cutting element 46 may be replaceable or interchangeable with different functions provided in the replacing devices. In the case of the two-sided cutting function shown in FIG. 5, the blades and slots on different sides may be different so that a single tool may have different uses. For example, side L may have a blade and slot designed for use with infant size nails (e.g., relatively small dimensions and a fine, sharp blade) and side R may have a larger slot and more rigorous blade to handle children's nails or adult nails. Similarly, the curvature of the slot 14 shown early may be more curved (smaller radius of curvature) on one side than on the other side of the device.

The nail clipping system according to the present technology can be further described as having:

a) two opposed surfaces hinged at one end, b) associated with an upper one of the two opposed surfaces is at least one exterior plate, c) associated with a lower one of the opposed surfaces is at least one interior plate directly opposed to the exterior plate;

d) the at least one exterior plate has a slot therein accessible to finger nails;

e) the at least one upward interior plate has rigidly attached thereto a blade element that slides along an interior surface of the downward exterior plate and across the slot therein.

The nail clipping system may have elements b) and c) are integrally formed with the opposed surfaces or May have elements b) and c) as separate components individually secured between the opposed surfaces. Elements b) and c) may be attached components collectively secured between the opposed surfaces. There may be two exterior plates b) that are on opposite sides of the nail clipping system, and there are two interior plates c), each of which is directly opposed to one exterior plate, each exterior plate having a slot therein. Each of the two opposed exterior plates should have one slot therein, a slot in one exterior plate having dimensions such that volume of the slot in the one exterior plate is at least 10% greater than the volume of a slot in the other exterior plate. Pressure caused by a blade element sliding along the interior surface of the downward exterior plate causes the exterior plate to flex outwardly. Elements b) and c) may individually slide, snap, screw or bolt to opposed surfaces or attached elements b) and c) collectively slide, snap, screw or bolt to opposed surfaces.

The upper and lower plates may be provided with a gripping or anti-slip coating. This may be conveniently provided by painting, coating, dip-coating, burnishing, or otherwise altering the surface of the plates that contact the fingers of the user. A preferred method is dip-coating into a dryable or curable coating composition (solution, suspension, dispersion, etc.) and hardening the composition appropriately. A typical composition would be a thermally or radiation-curable polyvinyl chloride composition, especially one containing particles to add textures to the surface of the coating after hardening. A solvent coating that can be air dried or thermally dried is also useful.

The abrasive element on the device can also be an insert that forms a trough (84 in FIG. 5), where the preferred orientation is to have the curve of the slot concave to the open surface of the trough so that clipped nail particles 86 may be captured.

Although specific materials, dimensions and shapes have been described in enabling practice of the present invention, variations within the scope of the invention and within the scope of the claims are available to those of ordinary skill in the art.

What is claimed:

1. A method of forming a nail cutting system comprising a form that is bendable at at least five different locations to form the system of a nail clipping system comprising: a) two opposed surfaces hinged at one end, b) associated with an upper one of the two opposed surfaces is at least one downward exterior plate, c) associated with a lower one of the opposed surfaces is at least one upward interior plate directly opposed to the downward exterior plate; d) the at least one downward exterior plate has a slot therein accessible to finger nails; e) the at least one upward interior plate has rigidly attached thereto a blade element that slides along an interior surface of the downward exterior plate and across the slot therein, the process comprising bending in five different connection points between:

1) a first plate with a blade and a first flat leverage plate;

2) a second plate with a blade and the first leverage plate;

3) a third plate with a slot and a second leverage plate;

4) a fourth plate with a slot and the second leverage plate; and 5) a living hinge between the first leverage plate and the second leverage plate providing and bending the form at least five times so that flexing along the living hinge causes at least the second plate with the blade to slide along the third plate with a slot so that the blade slides over the slot to cut protruding material passing through the slot;

wherein the bending at the at least five different locations form the nail cutting system.

2. The method of forming a nail cutting system of claim 1 wherein the form is bent to form a nail clipping system wherein there are two exterior plates b) that are on opposite sides of the nail clipping system, and there are two interior plates c), each of which is directly opposed to one exterior plate, each exterior plate having a slot therein and bending the form at least five times so that flexing along the living hinge causes at least the second plate with the blade to slide along the third plate with a slot so that the blade slides over the slot to cut protruding material passing through the slot.

3. The method of claim 1 wherein one of the two opposed surfaces has an abrasive material exposed on an exterior surface of the one opposed surface and the form is bent to provide the abrasive surface on an exterior surface of the nail clipping system.

4. A method of bending a form to form a nail clipping system comprising:

providing a bendable form that is bendable at at least five different locations to form the system of a nail clipping system comprising: a) two opposed surfaces hinged at one end, b) associated with an upper one of the two opposed surfaces is at least one downward exterior plate, c) associated with a lower one of the opposed surfaces is at least one upward interior plate directly opposed to the downward exterior plate; d) the at least one downward exterior plate has a slot therein accessible to finger nails;

e) the at least one upward interior plate has rigidly attached thereto a blade element that slides along an interior surface of the downward exterior plate and across the slot therein, the process comprising bending in five different positions comprising connection points between: 1) a first plate with a blade and a first flat leverage plate; 2) a second plate with a blade and the first leverage plate; 3) a third plate with a slot and a second leverage plate; 4) a fourth plate with a slot and the second leverage plate; and 5) a living hinge between the first leverage plate and the second leverage plate and bending the form at least five times so that flexing along the living hinge causes at least the second plate with the blade to slide along the third plate with a slot so that the blade slides over the slot to cut protruding material passing through the slot, and wherein the bending at the at least five different locations form the nail cutting system.

5. The method of claim 4 wherein, the bendable form is manufactured by elements b) and c) being integrally formed with the opposed surfaces.

6. The method of claim 5 wherein one of the two opposed surfaces has an abrasive material exposed on an exterior surface of the one opposed surface and the form is bent to provide the abrasive surface on an exterior surface of the nail clipping system.

7. The method of claim 4 wherein, the bendable form is manufactured by elements b) and c) being separate components and then elements b) and c) are individually secured between the opposed surfaces.

8. The method of claim 7 wherein elements b) and c) are individually slid, snapped, screwed or bolted to opposed surfaces.

9. The method of claim 4 wherein, the bendable form is manufactured by first attaching elements b) and c) to each other and after b) and c) are attached collectively securing attached b) and c) between the opposed surfaces.

* * * * *